United States Patent [19]

Greene

[11] Patent Number: 5,056,436

[45] Date of Patent: Oct. 15, 1991

[54] SOLID PYROTECHNIC COMPOSITIONS FOR PROJECTILE BASE-BLEED SYSTEMS

[75] Inventor: Robert W. Greene, Costa Mesa, Calif.

[73] Assignee: Loral Aerospace Corp., New York, N.Y.

[21] Appl. No.: 252,626

[22] Filed: Oct. 3, 1988

[51] Int. Cl.[5] ..... F42B 13/12

[52] U.S. Cl. ..... 102/490; 102/374; 102/501

[58] Field of Search ..... 102/490, 501, 374; 149/19.7

[56] References Cited

U.S. PATENT DOCUMENTS

| | | | |
|---|---|---|---|
| 3,014,796 | 12/1961 | Long et al. | 149/19.7 |
| 3,113,057 | 12/1963 | Butcher | 149/19.7 |
| 3,862,866 | 1/1975 | Timmerman | 149/21 |
| 3,880,595 | 4/1975 | Timmerman | 149/76 |
| 3,886,009 | 5/1975 | Puchalski | 149/43 |
| 3,910,805 | 10/1975 | Catanzarite | 149/83 |
| 3,964,256 | 6/1976 | Plantif et al. | 149/19.6 |
| 3,986,908 | 10/1976 | Grébert et al. | 149/19.7 |
| 4,128,443 | 12/1978 | Pawlak et al. | 149/71 |
| 4,130,061 | 12/1978 | Boggs et al. | 102/501 |
| 4,213,393 | 7/1980 | Gunners et al. | 102/374 |
| 4,302,259 | 11/1981 | Ward | 149/61 |
| 4,452,145 | 6/1984 | Klohn et al. | 102/501 |
| 4,497,676 | 2/1985 | Kurtz | 102/431 |
| 4,691,633 | 9/1987 | Godfrin et al. | 102/501 |
| 4,726,291 | 2/1988 | Lefranc | 102/214 |
| 4,756,252 | 7/1988 | Melhus et al. | 102/374 |
| 4,807,535 | 2/1989 | Schilling et al. | 102/490 |

OTHER PUBLICATIONS

Moyer, "Explosives", p. 27, Verlog Chemie (1977), N.Y.

*Primary Examiner*—Edward A. Miller

*Attorney, Agent, or Firm*—Edward J. Radlo; Greg T. Sueoka; Lorraine S. Melotik

[57] ABSTRACT

The invention is directed to a solid, pyrotechnic composition as a base-bleed composition for reducing the base-drag of non-self-propelled projectiles. The composition comprises a oxygenated hydrocarbon component and an oxidizing agent component.

10 Claims, No Drawings

SOLID PYROTECHNIC COMPOSITIONS FOR PROJECTILE BASE-BLEED SYSTEMS

TECHNICAL FIELD

This invention relates to non-self-propelled projectiles and more particularly to base-bleed, pyrotechnic compositions for reducing the base-drag of non-self-propelled projectiles.

BACKGROUND OF THE INVENTION

In flight, a gun fired (non-self-propelled) projectile, such as a bullet, shell, etc. forms a partial vacuum adjacent to the rear or base of the projectile. This partial vacuum or low pressure area creates a force which acts on the projectile in a direction opposite its motion, thereby lessening the flight velocity of the projectile. This force is commonly referred to as "base-drag".

In an attempt to reduce base-drag, various pyrotechnic materials have been loaded into base cavities in the projectiles and ignited at the time of discharge. The products from the burning of the pyrotechnic material at least partially offset the vacuum generated by the projectile, reducing base-drag and aiding the flight of the projectile. Optimally, an ambient pressure equal to atmospheric is created by the products emitted by the burning of the pyrotechnic materials in the projectile. Pressures exceeding atmospheric could undesirably cause the bullet or projectile to be deflected from its intended path. In order to efficiently utilize the base flow effect, it should occur during a considerable part of the flight time. The object of base-bleed charge is not to create any effect comparable with the, effect of a rocket motor, i.e., to cause an additional reaction force or thrust acting on the projectile in the direction of the trajectory, but merely to arrange for a low pressure flow of mainly gaseous combustion products, thus reducing the base-drag acting on the projectile during flight.

In U.S. Pat. No. 4,213,393, Gunners et al disclose reducing base-drag of a gun projectile by ejecting a flow of gas into and liberating heat in the near wake zone of the projectile base. The base-drag reduction means involves a combustion chamber, nozzle and propellant grain means of a fuel rich composition located in the combustion chamber and presenting a burning area operable to be ignited upon exit from the muzzle of the gun. According to Gunners et al, in flight the pressure in the combustion chamber only slightly exceeds the pressure at the base (0.01–0.5 bar). Further, this patent discloses that the total area of the base, the area of the restricted gas outlet and the dimensionless mass flow rate of the ejected gas are to be in a defined mathematical relationship.

Various pyrotechnic materials have been suggested for use to reduce base-drag, including liquid and solid materials. The materials for use in the base of projectiles are commonly referred to as "fumers" or "base-bleed" materials. It is desired that such materials be more easily ignited, have a slower burning rate and burn at a lower temperature than conventional fuel mixes used, e.g., in rocket motors. Solid fumers generally use dry pyrotechnic powder components that must be formed into a consolidated state, i.e., a propellant set, by mixing with bonding agents. These solid, molded fumers are generally cylindrical in shape and have an axial combustion channel. Often they are insulated at their external surfaces in order that an orderly burn-up from the inside of the channel to the outside, with the gases venting out the channel, is guaranteed.

Puchalski, in U.S. Pat. No. 3,886,009, discloses a solid pyrotechnic mixture used to reduce base-drag which requires stoichiometric portions of fuel and oxidizer. It contains magnesium powder as the fuel and strontium nitrate as the oxidizer. In addition, it contains calcium resinate as a binder and gelatin to provide low molecular weight products upon ignition. According to the patent's teachings, the mixture should burn at high yield temperatures of at least 2700° C. in order to ensure the production of sufficient pressure within the base area during flight. It is further taught in that Patent that the combustion products are primarily gaseous although some liquid and solid particles are also emitted into the void behind the projectile during the burning process.

Boggs et al, in U.S. Pat. No. 4,130,061, teaches that a fumer exhibiting reduced base-drag can be achieved without the high yield temperatures mentioned above by utilizing a pyrotechnic material comprising fuel (metal powder, resin and plasticizer) and oxidizers (alkaline earth metal compound and oxidizer) in greater than stoichiometric amounts. It is taught in this patent that the excess fuel composition has the dual function of not only providing an appropriate initial reaction but also providing a hot ready-state where excess fuel-rich combustion products will secondarily react with oxygen in the atmosphere to rapidly fill the void immediately adjacent the base of the Projectile, i.e., the near wake zone.

Ward, in U.S. Pat. No. 4,302,259, teaches an improved pyrotechnic fuel composition comprising a metal fuel and a conventional pyrotechnic oxidizer, wherein the improvement comprises the use of a metal hydride as the fuel ingredient. According to this patent, employing, e.g., $MgH_2$ instead of Mg produces a pyrotechnic composition which readily ignites, has a lower burning rate for increased luminous intensity, and desirably has a higher specific impulse.

Klohn et al, in U.S. Pat. No. 4,452,145, teach a process for the manufacture of insulated propellant sets for base-bleed gas generators in order to provide that the sets are consumed during burning from inside to outside as desired. According to the improvement of the invention, the propellant is introduced into an insulating envelope which contains a thermoplastically deformable elastomer. The propellant sets consist of a propellant containing one or more solid substances, at least one of which is an oxidant, and a binder being a thermoplastically deformable elastomer. During compression of the envelope about the propellant at increased temperatures, an intimate bond is formed between the binder of the propellant and the envelope containing the same type of thermoplastically deformable elastomer as main component. An exemplary propellant disclosed to be a mixture comprising ammonium perchlorate as the oxidant, nitroguanidine as the fuel, trioctyl phosphate as a plasticizer and a thermoplastically deformable elastomer like butadiene-styrene copolymer as the binder.

However, solid base-bleed, pyrotechnic compositions may suffer from disadvantages such as high cost, difficulty in processing and unsuitability for high gas rate production over an extended period of time. Often such solid compositions are high burning temperature materials which require special fabrication of the chamber in which they are placed in the projectile. Still further, the compositions may produce such liquid and solid combustion products which, in addition to making the composition not clean burning, may decrease the efficiency of the composition. Other fumers of the castable type also may be undesirable because of their inconsistent burning rate and performance.

Kurtz, in U.S. Pat. No. 4,497,676, discloses preparation of a composition useful with firearms as a substitute for a wide variety of gunpowder formulations, including black powder, as well as being suitable for consumable cartridges and cartridge cases and solid propellent applications. The composition comprises between 50–75% of an inorganic nitrate, such as potassium nitrate and ammonium nitrate, and between 25–50% by weight of an organic acid: erythorbic acid and ascorbic acid and mixtures thereof. The composition disclosed by Kurtz is also suitable as the base-bleed, pyrotechnic composition of the present invention. Kurtz does not teach employing such composition in base-bleed systems of non-self-propelled projectiles to reduce the base-drag thereof.

BRIEF DESCRIPTION OF THE INVENTION

The invention is directed to a method for using a solid pyrotechnic composition as a base-bleed composition for reducing the base-drag in a nonself-propelled projectile. The method comprises providing a non-self-propelled projectile having a cavity therein and fluid communication between the cavity and near wake zone at the base of the projectile, and loading said cavity with a pyrotechnic composition that provides upon burning of the composition a low mass flow of gaseous products in the near wake zone of the projectile. The low mass flow is sufficient to increase the base pressure in the near wake zone and decrease the base-drag of the projectile. Preferably, the low mass flow of gaseous products is provided during a considerable portion of the non-self-propelled projectile flight time. The solid base-bleed pyrotechnic composition comprises:

(A) oxygenated hydrocarbon component having a melting point above 90° C.; and (B) oxidizing agent comPonent.

Advantageously, the oxygenated hydrocarbon component and the oxidizing agent component are preferably present in the composition in amounts sufficient to oxidize substantially all of the carbon atoms present in the oxygenated hydrocarbon component to carbon dioxide so that the composition is clean burning, i.e., little or no carbon is produced. The presence of the oxygen atoms in the oxygenated hydrocarbon fuel molecules greatly reduces the amount of oxygen required to be supplied by the oxidizing agent component, thus maximizing the percentage of fuel which may be present in the composition.

According to another aspect of the invention, a non-self-propelled projectile has a cavity therein in fluid communication with the near wake zone at the base of the projectile loaded with the pyrotechnic composition described above which provides upon burning of the composition a low mass flow of gaseous combustion products in the near wake zone of the projectile. The low mass flow of combustion products is sufficient to increase the base pressure in the near wake zone and decrease the base-drag of the projectile.

Advantageously, the base-bleed solid pyrotechnic composition of the invention provides a low cost, safe, and efficient means for reducing the base-drag of non-self-propelled projectiles. The composition is suitable for a high rate of production of gaseous combustion products, $C0_2$ and $H_2O$. Preferred embodiments of the base-bleed compositions disclosed herein are lower in burning rate than conventional metallic base-bleed fuel compositions, thus providing at least equal performance (gas generation) by means of a smaller volume of fuel. These compositions also are cooler burning than conventional metallic base-bleed fuel compositions so that the projectile cavity in which they are enclosed would not be required to be as heat resistant as that enclosing a hotter burning conventional metallic fuel. Preferred embodiments of the base-bleed fuel of this invention are also easier to ignite than conventional metallic base-bleed fuels. Additionally, as compared to conventional metallic fuels, preferred embodiments of the base-bleed compositions of this invention advantageously produce combustion products less likely to accumulate and clog the nozzle of the base-bleed system of the projectile. Still further, due to the low burning pressure of embodiments of the pyrotechnic composition of this invention as compared to that of conventional metallic base-bleed fuels, the inside wall of the combustion chamber of the projectile advantageously would not require as much reinforcement.

DETAILED DESCRIPTION OF PREFERRED EMBODIMENTS

As described briefly above, the present invention is directed to a method of using a solid, base-bleed pyrotechnic composition to reduce the base-drag of a non-self-propelled projectile. The solid base-bleed, pyrotechnic composition comprises (A) oxygenated hydrocarbon component and (B) oxidizing agent component. Each of these components as well as optional materials and other aspects of the invention will be discussed in detail herein below.

One component of the composition of the invention is an oxygenated hydrocarbon having a melting point above about 90° C., more preferably above about 110° C., and most preferably above about 180° C. By oxygenated hydrocarbon it is meant a compound containing carbon, hydrogen and oxygen, i.e., a compound having the general chemical formula: $C_xH_yO_z$. As will be apparent to one skilled in the art in view of the present disclosure, the family of oxygenated hydrocarbons represented by this formula include acids, esters, lactones, carbohydrates, etc. and are numbered in the hundreds, many of which are commercially available. Exemplary of such materials are dehydroacetic acid ($C_8H_8O_4$), sorbital ($C_6H_{14}O_6$), ascorbic acid ($C_6H_8O_6$), adipic acid ($C_6H_{10}O_4$), lactose ($C_{12}H_{22}O_{11}$), glucose ($C_6H_{12}O_6$), and the like. Suitable mixtures of any of them may also be employed as the oxygenated hydrocarbon fuel of the PYrotechnic composition.

Another component of the pyrotechnic composition of the invention is an oxidizing agent. Numerous pyrotechnic oxidizers are known to those skilled in the art. They include materials such as nitrates, nitrites, chlorates, chlorites and perchlorates. Such materials may be suitably employed in the composition of the present invention to provide oxygen to combust the oxygenated hydrocarbon component. Exemplary of an oxidizing agent which may be useful in the composition of the invention disclosed herein is potassium perchlorate. The oxygenated hydrocarbon component and the oxidizing agent component of the base-bleed composition of the present invention are selected so as to provide during combustion thereof the desired low mass flow of combustion products. Potassium perchlorate, as compared to potassium nitrate, for example, optimally allows embodiments of base-bleed compositions disclosed herein to optimally burn more slowly. Still other oxidizers, or suitable mixtures of oxidizers, which may be used in this invention will be apparent to those skilled in the art in view of the present disclosure.

Advantageously, since oxygen atoms are present in these fuel molecules, the amount of oxygen which must be supplied by the oxidizer to burn the fuel is reduced. This minimizes, or at least reduces, the percentage of oxidizer which must be present in the pyrotechnic composition and, correspondingly, advantageously maximizes, or at least increases, the percentage of fuel which may be present in the composition. The percentages of oxygenated hydrocarbon and oxidizing agent present in the base-bleed, solid pyrotechnic composition of this invention may vary considerably over a wide range while still providing a useful base-bleed pyrotechnic composition. According to preferred embodiments, however, the oxygenated hydrocarbon composition and the oxidizing agent component are present in the composition in amounts sufficient to oxidize substantially all of the carbon in the oxygenated hydrocarbon component to carbon dioxide, i.e., to completely combust all of the oxygenated hydrocarbon.

As is known to those skilled in the art, during combustion the carbon atoms in the fuel molecules are oxidized to carbon dioxide if sufficient oxygen is present. On the other hand, carbon monoxide (CO) or elemental carbon are undesirably produced in an oxygen-deficient atmosphere. If a substantial amount of carbon is generated, a "sooty" flame is observed. As a result of combustion, the hydrogen present in organic compounds are oxidized to water molecules. For a fuel of formula $C_xH_yO_z$, moles of $CO_2$ and y/2 moles of water will be produced per mole of fuel if it is completely combusted. To completely combust this fuel, $x+y/2$ moles of oxygen gas ($2x+y$ moles of oxygen atoms) will be required. The amount of oxygen that must be provided by the oxidizer in a high-energy fuel mixture is reduced by the presence of oxygen atoms in the fuel molecule. Thus, a fuel that contains only carbon and hydrogen (a hydrocarbon) or a typical base-bleed material like aluminum will require more moles of oxygen for complete combustion than will an equal weight of an oxygenated hydrocarbon compound. A lesser weight of an oxidizer is therefore required per gram of fuel when a oxygenated hydrocarbon-type material is used.

The grams of oxygen needed to completely combust one gram of a given oxygenated hydrocarbon fuel can be calculated from the balanced chemical equation. Using glucose and potassium perchlorate as an example, the equation for the reaction is $C_6H_{12}O_6+3KC10_4 \rightleftarrows 6CO_2+b\ 6H_2O+3KCl$. For any fuel of this form when completely combusted, the number of carbon atoms in the fuel molecule is equal to the number of $CO_2$ molecules formed in the combustion products and each 2 hydrogen atoms in the fuel molecule form an $H_2O$ molecule. The additional oxygens required come from the oxidizer and, possibly, the atmosphere. In the above equation, one mole of glucose would require three moles of potassium perchlorate (a 1:3 stoichiometric relationship) to completely combust the fuel. Complete combustion in this particular situation would require a base-bleed composition comprising: 69.9% $KC10_4$ by weight.

For completely combusting base-bleed compositions comprising the oxygenated hydrocarbons listed below using potassium perchlorate as the oxidizing agent, the composition would preferably comprise the following % by weight $KC10_4$:

| Base-bleed Fuel | | % By Weight Oxidizer ($KClO_4$) |
|---|---|---|
| $C_8H_8O_4$ | (Dehydroacetic Acid) | 76.7% |
| $C_6H_{14}O_6$ | (Sorbital) | 71.1% |
| $C_6H_8O_6$ | (Ascorbic Acid) | 66.3% |
| $C_6H_{10}O_4$ | (Adipic Acid) | 75.5% |
| $C_{12}H_{22}O_{11}$ | (Lactose) | 70.9% |

Optional components also may be present in the base-bleed pyrotechnic composition of the invention. Exemplary of conventional optional materials (modifiers) often included in pyrotechnic compositions are binders, and materials used for (1) producing more saturated color flames, (2) adjusting burning rates, (3) producing colored smoke clouds, (4) increasing storage life, and (5) increasing processing safety.

A pyrotechnic composition will usually contain a small percentage of an organic polymer that functions as a binder, holding all of the components together in a homogeneous blend. These binders, being organic compounds, may also serve as fuels in the mixture. Without the binder, materials might well segregate during manufacture and storage due to variations in density and particle size. During the granulation process, the oxidizer, fuel, and other components are blended with the binder (and usually a suitable solvent) to produce grains of homogeneous composition. The solvent is evaporated following granulation, leaving a dry, homogeneous material.

The base-bleed pyrotechnic composition of this invention is generally prepared by mixing the oxygenated hydrocarbon, oxidizing agent and any optional components in powder form. The mixture can be compressed by means of conventional techniques, into any desired shape, or be used in powdered form. Generally the pyrotechnic material would be compressed into a shape which corresponds to the cavity of the projectile into which such material is to be placed. A depression is generally formed in the pyrotechnic material adapted to accept a suitable igniter composition. The base-bleed pyrotechnic composition together with a suitable igniter composition can be inserted as one unit in the cavity.

The base-bleed compositions disclosed herein are generally placed in a rearward portion of a projectile. The invention is not restricted, however, to applications where the cavity is placed in the aft part of the projectile. The cavity can be placed anywhere in the projectile as long as fluid communication is provided between the cavity (combustion chamber) and the near wake zone of the projectile base. If the cavity is located at the base of the projectile, the composition can be held in position by a base plate having one or a number of gas outlet nozzles. The base plate can be arranged with an external screw thread and a corresponding internal thread is cut on the rear portion of the hollow based structure.

As discussed above, combustion of the base-bleed composition of this invention during the flight of a projectile causes a low mass flow of gaseous products to be emitted into the otherwise less-than-atmospheric Pressure area (near wake zone) at the base of the projectile and thereby reduces the base-drag of the projectile. According to this invention, the low mass flow provided in the near wake zone of the non-self-propelled projectile is sufficient to increase the base pressure in the near wake zone and decrease the base-drag of the projectile. It is typically understood by those in the art that such low mass flow is desired to be less than that which would assist propulsion of the projectile, i.e., in flight the pressure created by the burning composition preferably should not exceed atmospheric pressure.

As will be apparent to those skilled in the art in view of the present disclosure, the exit area of the outlet nozzle(s), and the burning area, the mass and the static burning rate of the composition are so chosen that the low mass flow of gaseous combustion products is operable to continue generally from the time of muzzle exit and for a considerable portion of the projectile flight. The quantity of the blended charge required is equal to the product of the time of flight requiring base-drag reduction times the rate of consumption of the base-drag composition. In order to efficiently utilize the base flow effect, this low mass flow of gaseous combustion products is provided preferably during a considerable portion of the projectile flight time, i.e., during at least a considerable portion of a useful trajectory for the non-self-propelled projectile. Preferably, the low mass flow of combustion products are provided during at least 30% of the projectile flight time, more preferably, this flow is provided during at least 50% of projectile flight time, and most preferably provided during greater than 80% of projectile flight time of the non-self-propelled projectile. The flow may be provided during 100% of the flight time. Selection of optimal percentage of the flight time (useful trajectory) during which flow of the combustion products is provided will be within the skill of one in the art in view of the present disclosure. A useful trajectory is meant herein to be that trajectory which would allow the non-self-propelled projectile to reach its intended target. As would be apparent to those skilled in the art in view of the present disclosure, a particular projectile may have more than one useful trajectory.

In view of this disclosure, many modifications of this invention will be apparent to those skilled in the art. It is intended that all such modifications which fall within the true scope of this invention be included within the terms of the appended claims.

I claim:

1. A method for reducing the base-drag of a non-self-propelled projectile comprising the steps of:

providing a non-self-propelled projectile having a cavity wherein and fluid communication between said cavity and the near wake zone at the base of said projectile;

loading said cavity with a pyrotechnic composition that provides upon burning of said composition a low mass flow of gaseous combustion products in the near wake zone of said projectile, said low mass flow of combustion products being sufficient to increase the base pressure in the near wake zone and decrease the base-drag of said projectile, wherein said pyrotechnic composition comprises:

(A) oxygenated hydrocarbon component selected from the group consisting essentially of dehydroacetic acid, sorbital, ascorbic acid, adipic acid, lactose, glucose, and mixtures of any of them, said oxygenated hydrocarbon component having a melting point above 90° C.; and (B) oxidizing agent component; and reacting said oxygenated hydrocarbon component with said oxidizing agent component during at least a portion of flight of said projectile.

2. The method for reducing base-drag according to claim 1, wherein said composition comprises (A) and (B) in amounts sufficient to oxidize substantially all of the carbon atoms in said oxygenated hydrocarbon component to carbon dioxide.

3. The method for reducing base-drag according to claim 1, wherein said oxygenated hydrocarbon component has a melting point above about 110° C.

4. The method for reducing base-drag according to claim 3, wherein said oxygenated hydrocarbon component has a melting point above about 180° C.

5. The method for reducing base-drag according to claim 1, wherein said oxidizing agent component is selected from the group consisting essentially of nitrates, nitrites, chlorates, chlorites and perchlorates, and mixtures of any of them.

6. The method for reducing base-drag according to claim 5, wherein said oxidizing agent component is potassium perchlorate.

7. The method for reducing base-drag according to claim 1, wherein said low mass flow of gaseous combustion products is provided during a considerable portion of said non-self-propelled projectile flight time.

8. The method for reducing base-drag according to claim 7, wherein said low mass flow of gaseous combustion products is provided during at least about 30% of said non-self-propelled projectile flight time.

9. The method for reducing base-drag according to claim 8, wherein said low mass flow of gaseous combustion products is provided for at least about 50% of said non-self-propelled projectile flight time.

10. The method for reducing base-drag according to claim 9, wherein said low mass flow of gaseous combustion products is provided for at least about 80% of said non-self-propelled projectile flight time.

* * * * *